United States Patent [19]

Burn

[11] 4,038,699

[45] Aug. 2, 1977

[54] SOCK WITH INTEGRALLY KNIT POCKET AND METHOD

[75] Inventor: William H. Burn, Niota, Tenn.

[73] Assignee: The Pocket Socks Corporation, Niota, Tenn.

[21] Appl. No.: 717,767

[22] Filed: Aug. 25, 1976

Related U.S. Application Data

[63] Continuation-in-part of Ser. No. 623,982, Oct. 20, 1975, Pat. No. 4,005,494.

[51] Int. Cl.[2] ..... A41B 11/00

[52] U.S. Cl. ..... 2/239; 66/173; 66/178 R; 66/189

[58] Field of Search ..... 2/239, 240, 241; 66/173, 172 R, 171, 170, 176, 177, 178 R, 189

[56] References Cited

U.S. PATENT DOCUMENTS

| | | | |
|---|---|---|---|
| 481,351 | 8/1892 | Gee | 66/189 |
| 767,381 | 8/1904 | Brown | 2/239 |
| 1,045,620 | 11/1912 | Scott | 66/173 |
| 1,072,640 | 9/1913 | Nydegger | 66/171 |
| 1,206,171 | 11/1916 | Thierfelder | 66/173 X |
| 3,283,545 | 11/1966 | Simon | 66/189 X |

*Primary Examiner*—H. Hampton Hunter
*Attorney, Agent, or Firm*—Bell, Seltzer, Park & Gibson

[57] ABSTRACT

The pocket is formed of first and second layers of knit fabric formed of partial courses to provide a looped fabric section integral with the leg of the stocking. The looped open sides of the pocket are stitched together after knitting to complete the pocket. The partial courses in the lower portions of the first and second layers are all of the same length and may be knit with reciprocation or rotary knitting and the partial courses at the upper ends of the first and second layers are "fashioned" with their opposed ends being connected together during the knitting operation.

9 Claims, 6 Drawing Figures

SOCK WITH INTEGRALLY KNIT POCKET AND METHOD

This application is a continuation-in-part of my prior application Ser. No. 623,982, filed Oct. 20, 1975, now U.S. Pat. No. 4,005,494 dated Feb. 1, 1977, and relates generally to improvemets in the sock disclosed in said application.

The layers of fabric forming the pocket in the sock disclosed in my prior application are illustrated as being of equal length and being directly connected with full or complete seamless courses in the leg of the sock. This construction causes some difficulty in sewing together the opposite edges of the layers of the pockets because the sewing operator must terminate the seaming at a precise location, i.e., the point at which the two layers of fabric are joined to the full circular courses. If the seam does not extend to the juncture point of the two layers, an open hole is left in the stocking. If the seam extends beyond the juncture of the two layers of fabric, portions of the leg of the stocking extending above the pocket are joined together by the seam and presents an unsightly appearance. Also, the partial courses in the pocket of my prior application are illustrated as being knit with uncut selvage edges along opposite sides and the knitting of this type of selvage on a circular knitting machine requires reciprocation of the needle cylinder thereby increasing the time required to produce the sock.

With the foregoing in mind, it is an object of the present invention to provide an improved pocket sock and method of knitting the same whereby a few "fashioned" partial courses are formed at the upper end of the pocket and their opposite ends are connected to each other during the knitting operation to aid the operator in the later seaming of opposite sides of the pocket. Also, the partial courses of equal length in the two layers of the pocket fabric may be knit with continuous rotation of the needle cylinder so that they include cut yarn ends extending outwardly therefrom to provide cut selvage edges along opposite sides of the first and second layers to thereby reduce the time required in knitting the pocket.

In accordance with the present invention, the pocket has an opening extending partially around the leg portion of the sock and spaced below the cuff of the sock. The pocket extends downwardly along the leg portion from the opening and includes first and second layers of knit fabric formed of partial courses. A few of the partial courses at the upper ends of the first and second layers of knit fabric are "fashioned" with the partial courses knit at the upper end of the first layer being gradually reduced in length (narrowed) and the partial courses knit at the upper end of the second layer being gradually increased in length (widened) so that the opposed ends of the "narrowed" partial courses are joined to the opposed ends of the "widened" partial courses along corresponding gore lines. The partial courses of equal length comprising the lower ends of the first and second layers of the pocket may be knit with either reciprocation of the needle cylinder to form uncut selvage edges along opposite sides of the first and second layers, or the equal length partial courses may be knit with continuous rotation of the needle cylinder to provide cut selvage edges with cut yarn ends extending outwardly therefrom along opposite sides of the first and second layers.

The pocket is integrally formed during the knitting of the leg portion of the sock and may be knit on any one of several well-known types of circular hosiery knitting machines and requires only minor changes in the conventional operation of the machine. The pocket is completed on the knitting machine, except for stitching together opposite sides of the pocket and the size of the pocket may be varied so that it will accommodate various types of articles. The opening of the pocket is preferably spaced below the cuff so that the cuff may be turned down over the pocket to conceal and/or maintain the articles in the pocket.

Other objects and advantages will appear as the description proceeds when taken in connection with the accompanying drawings, in which FIG. 1 is a perspective view of the pocket sock with the pocket being folded inside of the leg portion and supporting an article therein, illusrating the sock as it would appear when worn on the leg;

Figure 2:
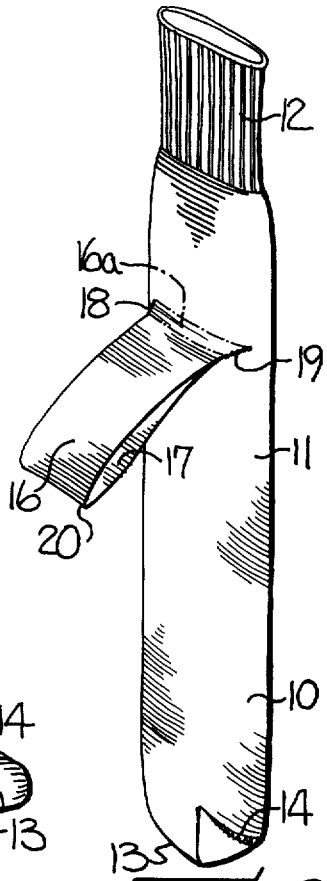
FIG. 2 is a perspective view of the pocket sock in substantially flattened condition, before the opposite sides of the pocket are sewn together and with the toe opening being closed.
Figure 4:
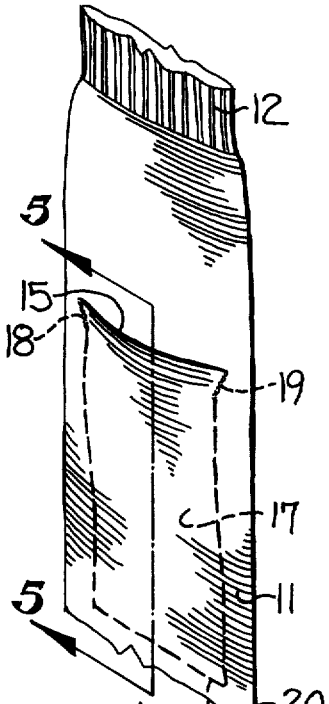
FIG. 4 is a perspective view of the upper portion of the sock in substantially flattened condition and with the pocket positioned down inside of the leg of the sock.
Figure 5:
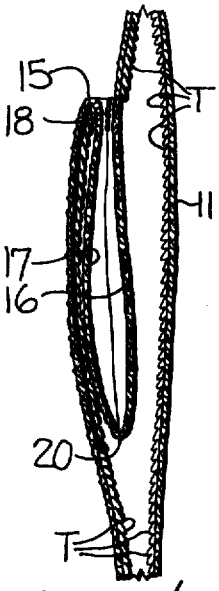
Figure 6:
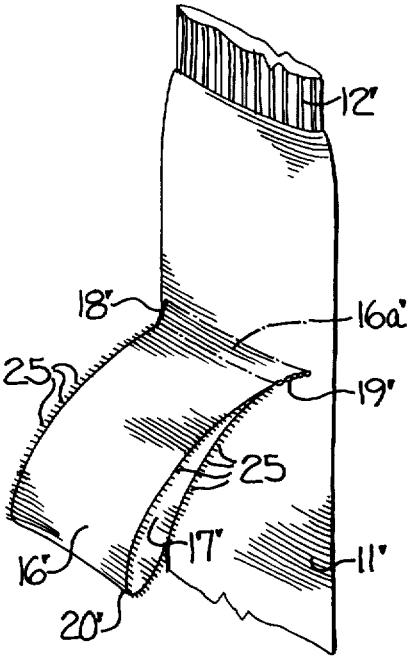

FIG. 5 is a fragmentary vertical sectional view through the pocket, being taken substantially along the line 5—5 in FIG. 4; and FIG. 6 is a view similar to the upper end portion of FIG. 2 but showing the opposite edges of the first and second layers of the pocket being formed with continuous rotation of the needle cylinder and forming cut selvage edges with cut yarn ends extending outwardly therefrom.

Figure 1:
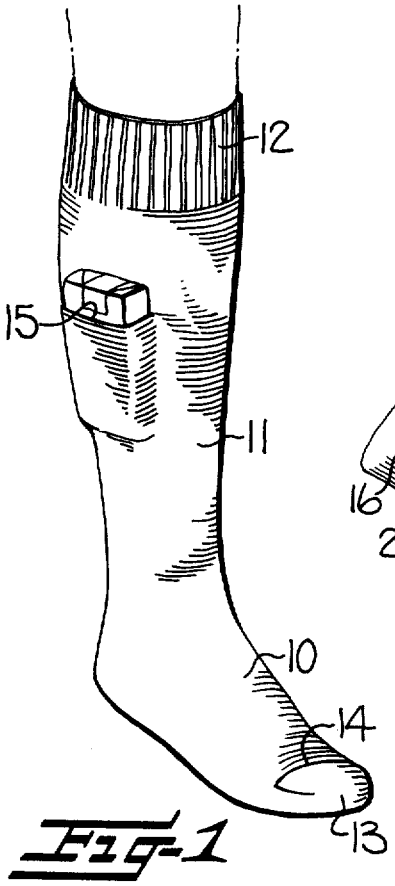

As illustrated in FIG. 1, the sock includes integrally knit respective foot, leg and cuff portions 10, 11 and 12 and with the foot portion 10 and leg portion 11 being knit throughout at least a major portion thereof of complete seamless courses with continuous rotation of the needle cylinder. The sock illustrated in the drawings is of the "tube" type with the foot portion 10 and the leg portion 11 being continuously knit with complete courses so that this sock does not contain the usual type or reciprocatorily knit heel pocket. However, it is to be understood that a preciprocatorily knit heel pocket may be provided, if desired. The foot portion 10 includes a toe portion 13 which may be formed in any suitable manner and the usual toe opening is closed by a line of stitching 14. The lines on the outside surface of the sock, below the cuff portion 12, indicate the direction of the courses and the wales extend perpendicular thereto.

The pocket includes an opening 15 (FIGS. 1, 4 and 5) extending partially around the leg portion 11 and the opening spaced below the cuff 12. As shown in FIGS. 1, 4 and 5, the pocket extends from the opening 15 and downwardly inside of the leg portion 11 and includes a first or inner layer of knit fabric 16 and a second or outer layer of knit fabric 17. The upper end of the first or inner layer 16 is joined to the leg portion 11 by a plurality of partial courses which gradually reduce in length to provide a fashioned section or gusset, indicated at **16*a* and extending between the dash dot lines in FIG. 2. The upper end of the second or outer layer 17 is also joined to the leg portion 11 by a plurality of partial courses which gradually increase in length to provide a fashioned section or gusset, indicated at 17***a* and extending between the dash dot lines in FIG. 3.

Figure 3:
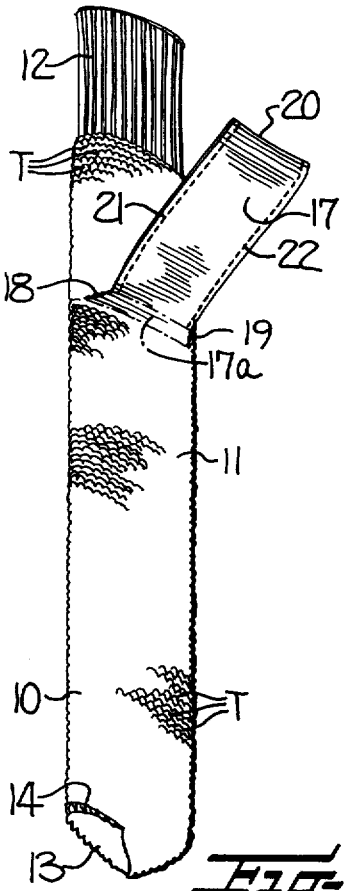
FIG. 3 is a view similar to FIG. 2 but showing the sock in everted condition and with the normally open opposite sides edges of the first and second layers of the pocket being stitched together along opposite sides thereof.

Opposed ends of the gradually reducing partial courses of the fashioned section 16*a* and the corresponding opposed ends of the gradually,increasing partial courses of fashioned section 17*a* are joined together along inwardly tapering gore lines 18, 19. The remaining partial courses in the first and second layers 16, 17 are of equal length and the lower ends of the first and second layers 16, 17 are integrally knit and joined along a fold line 20 extending across the lower end of the pocket. Stitching means, illustrated as lines of stitching 21, 22, extend along opposite sides of the pocket and join together the normally open opposite sides of the first and second layers 16, 17 (FIG. 3).

Thus, oppposite sides of the upper end portons of the first and second layers 16, 17 of the pocket are integrally joined together, along gore lines 18, 19, to thereby integrally knit the "corners" of the pocket opening. Because the upper end portions of the opposite sides of the first and second layers 16, 17 are joined together during the knitting operation, the termination of the upper ends of the seams 21, 22 is not as critical because they can extend up the gore lines 18, 19 for some distance, without effecting the outward appearance of the sock when the pocket is turned down inside of the leg, as shown in FIGS. 4 and 5.

As illustrated in the drawings, the partial courses of equal length forming the lower portions of the first and second layers 16, 17 of the pocket encompass substantially one-half the wales of the leg portion 11 of the sock and the length of the first and second layers 16, 17 substantially twice the width of the pocket. However, it is to be understood that these dimensions may be varied as desired to provide a larger or smaller pocket. When the pocket is positioned inside of the leg, as illustrated in FIGS. 1 and 4, the article carried therein may be concealed and/or maintained in the pocket by turning the cuff portion 12 downwardly thereover. Also, when the pocket is positioned on the outside of the leg, access to the pocket may be obtained by stretching the cuff portion 12 outwardly from the leg of the wearer.

The modified type of pocket formed in the sock illustrated in FIG. 6 is substantially the same as the first form of pocket illustrated in the sock shown in FIG. 2 and like reference characters are applied to corresponding parts with the prime notation added. Thus, the sock illustrated in FIG. 6 is provided with a cuff portion 12' and a leg portion 11', both of which are knit of complete seamless courses of body yarn. The pocket is formed of first and second layers 16', 17' of knit fabric formed of partial courses with the upper ends of the layers being joined to the full courses in the leg 11' by fashioned narrowed and widened gussets, only the narrowed gusset 16*a'* being shown in FIG. 6.

The narrowed gusset 16*a'* is formed with a plurality of partial courses of gradually reducing length while the widened gusset, not shown, is formed with partial courses of gradually increasing length which are joined at their opposed ends to the narrowed gusset 16'*a* along gore lines 18', 19'. However, the ends of the partial courses forming the lower portions of the first and second layers 16', 17' include cut selvage edges with cut yarn ends, indicated at 25, extending outwardly therefrom. The pocket is completed by sewing together opposite sides of the layers 16', 17', up to the gore lines 18'. 19'. The method of knitting this type of sock on a circular hosiery knitting machine will be presently described.

METHOD OF KNITTING

As a specific but non-limiting example, the method of knitting the sock shown in FIGS. 1–5 will be described as it is knit on a particular type of circular hosiery knitting machine. However, it is to be understood that the present sock may be knit on other types of knitting machines.

The sock is knit on 108 needle circular hosiery knitting machine and is knit from the upper edge of the cuff 12 to the toe opening closure 14. At the upper end of the cuff 12, the usual make-up is formed by inlaying elastic yarn on alternate needles for several revolutions of the needle cylinder and then a mock-rib fabric is knit to form the cuff 12 by feeding the elastic yarn to every fourth needle while floating the elastic yarn inside of the three intermediate needles to inlay the elastic yarn in the body yarn stitch loops in a well-known manner. After knitting the desired length of the cuff 12, the inlaying of the elastic yarn is discontinued and rotation of the needle cylinder is continued while feeding both a body yarn and a terry loop yarn to all of the needles to form plain jersey stitches on all of the needles with the body yarn and to form inwardly extending terry loops, indicated at T in FIG. 3, in the complete courses of the upper portion of the leg, before knitting the pocket. It is preferred that the pocket be formed after knitting approximately 28 complete courses below the cuff 12.

The pocket is then formed by switching the drive of the needle cylinder so that it reciprocates and substantially half of the needles (54 needles) are raised to an inactive or non-knitting position while the remaining 54 needles knit with each swing of the needle cylinder. A plurality of successive "narrowed" partial courses, which gradually reduce in length, are then knit by activating the usual narrowing picks of the knitting machine. With each successive swing of the needle cylinder, additional needles are raised to inactive position at the leading end of each partial course to form the "fashioned" gusset 16*a* with inwardly tapering opposite sides. It is preferred that four such narrowed courses be formed in the gusset 16*a* and that the partial courses of the pocket be knit of the body yarn only, after discontinuing the feeding of the terry yarn.

The operation of the narrowing picks in then discontinued and successive partial courses, all of the same length, are knit with each reciprocation of the needle cylinder to form a sufficient length of fabric to form the first and second layers 16, 17 with the open opposite selvage edge sides. The widening picks of the knitting machine are then activated and the gradually increasing or "widened" partial courses are knit to form the widened gusset 17*a* (FIG. 3). As these gradually widened partial courses are knit, the endmost stitch loops are joined to and knit with the stitch loops which have been held on the needles raised to inactive position during the knitting of the narrowed partial courses in the gusset 16*a* to form the gore lines 18, 19. Thus, the inwardly tapering opposite sides of the gusset 16*a* are joined to the outwardly tapering opposite sides of the gusset 17*a*. It is preferred that the gusset 17*a* also include four widened partial courses.

When the widened partial courses of gusset 17*a* are completed, the machine again switches to rotary knitting so that the needle cylinder is continuously rotated.

The 54 neeldes which have remained in the idle or non-knitting position during the formation of the layers 16, 17 of the pocket are again lowered to active or knitting position to agin form complete seamless courses. With the formation of the first complete seamless course below the pocket, the corresponding portion of the last complete seamless course of the group of complete courses above the pocket is joined to and integrally knit with the first complete course of the second group of complete courses below the pocket to provide the looped section of the partial courses, as illustrated in FIG. 2, and with the opposite side edges of the narrowed gusset 16*a* and the widened gusset 17*a* being integrally joined together along the gore lines 18, 19 and during the knitting process. With continued rotation of the needle cylinder, the remaining portions of the leg 11 and the foot 10 are knit with inwardly extending terry loops T and the toe portion 13 is then formed in any desired manner.

When the knitting of the sock blank is completed, the toe end of the sock is open and the opposite sides of the looped fabric formed by the partial courses of equal length in the lower portions of the first and second layers 16, 17 are unconnected and uncut selvage edges are formed along opposite sides of the first and second layers 16, 17. The pocket is then completed by sewing opposite side edges of the layers 16, 17 together, as illustrated by the dotted seam lines 21, 22 in FIG. 3. The seam lines 21, 22 extend from the fold line 20 and along opposite sides up to the gore lines 18, 19. The seams 21, 22 may be of any desired type and are preferably formed with at least the cuff 12 and the upper end of the leg portion 11 in everted condition, as illustrated in FIG. 3, so that the seamed edges are positioned inside of the leg of the sock and outside of the pocket when the pocket is turned down and positioned inside of the leg 11, as illustrated in FIGS. 4 and 5. The toe opening may be closed by the seam line 14 either before or after the opposite sides of the pocket are seamed.

The modified type of pocket is knit in the sock illustrated in FIG. 6 in substantially the same manner as the pocket illustrated in FIG. 2 except that the partial courses of equal length forming the first and second layers 16', 17' are formed with continuous rotation of the needle cylinder instead of reciprocatory movement of the needle cylinder, as described in connection with the knitting of the partial courses of equal length in the layers 16, 17. The knitting of the cuff 12', the upper portion of the leg 11', and the narrowed gusset 16*a'* is identical to the knitting of the corresponding parts of the sock shown in FIG. 2.

However, before beginning the knitting of the partial courses of equal length forming the layers 16', 17', the needle cylinder drive is switched to continuously rotate the needle cylinder and the inactive or non-knitting needles are lowered so that they pass beneath the stitch cams. The inactive needles are switched to follow a low inactive path beneath the stitch cams so that the yarns extending from the ends of the partial courses of equal length are free to float across the needle cylinder and across a dial plate equipped with a cutter so that the yarns are cut adjacent opposite sides of the partial courses as they are formed on the knitting machine. In this manner, it is not necessary to clip or cut the "floats" after knitting of the sock is completed and the partial courses in the layers 16', 17' are provided with selvage edges with cut yarn ends 25 extending therefrom (FIG. 6).

When knitting of the layers 16', 17' is completed, up to the upper end of the second layer 17', the needle cylinder again switches to reciprocatory movement and the inactive needles are raised to the upper inactive level to knit the widened gusset corresponding to the narrowed gusset 16*a'*. As inactive needles are brought back to active position by the widening picks during the knitting of the partial courses of the widened gusset, the endmost stitch loops are drawn through and joined to the held stitch loops in the narrowed gusset 16*a'* to form the gore lines 18', 19'. Thus, the opposite sides of the narrowed gusset 16*a'* and the widened gusset, not shown are joined along the gore lines 18', 19'.

The drive of the machine is again switched to continuously rotate the needle cylinder and the 54 needles which have remained in the idle or non-knitting position during formation of the pocket are again switched to the active or knitting postion to again form complete seamless courses. With the formation of the first complete course below the pocket, the corresponding portion of the last complete course of the group of complete courses above the pocket is joined to the first complete course of the second group of complete courses below the pocket to provide a looped section of the partial courses, as illustrated in FIG. 6. The upper ends of the looped sections of partial courses are thus joined to the corresponding complete courses of the leg by the respective narrowed gusset 16*a'* and the corresponding widened partial gusset, not shown. With continued rotation of the needle cylinder, the remaining portion of the leg 11' and the foot 10' are knit, with or without inwardly extending terry loops, and the toe portion 13' is then formed in any desired manner.

To complete the pocket, the cut selvage edges of the first and second layers 16', 17' are sewn together by any suitable type of seam. If desired, an overedge type of seam can be employed to incorporate therein the cut yarn ends extending outwardly from the cut sleeve edges of the layers 16', 17'. While the modified type of pocket shown in FIG. 6 is illustrated and described being knit with the rotary knit equal length partial courses of layers 16', 17' being connected to the leg 11' of the sock by means of the narrowed and widened gussets, it is to be understood that the looped sections of rotary knit partial courses of equal length 16', 17' may be directly connected at their upper ends of the complete seamless courses of the leg, in the same manner as indicated in my prior application.

In the drawings and specification, there has been set forth a preferred embodiment of the invention, and although specific terms are employed, they are used in a generic and descriptive sense only and not for purposes for limitation, the scope of the invention being defined in the claims.

That which is claimed is:

1. A sock including integrally and circularly knit foot, leg and cuff portions with said leg portion being knit throughout at least a major portion thereof of complete seamless courses of body yarn, and a pocket having an opening positioned below said cuff portion and extending partially around said leg portion, said pocket extending downwardly along said leg portion from said opening and comprising first and second layers of knit fabric formed of partial courses, the lower ends of said first and second layers of said pocket being integrally knit and joined along a fold line extending across the lower end of said pocket, said first layer of said pocket including an upper end portion integrally knit with said leg portion and comprising a plurality of said partial courses gradually reducing in length and the remainder of said partial courses in the lower portion of said first layer being of equal length, said second layer of said pocket including an upper end portion integrally knit with said leg portion and comprising a plurality of said partial courses gradually increasing in length and the remainder of said partial courses in the lower portion of said second layer being of equal length, opposed ends of said gradually reducing partial courses of said first layer being joined along gore lines to the corresponding opposed ends of said gradually increasing partial courses of said second layer, and stitching means extending along opposite sides of said pocket and joining said equal length partial courses of said first and second layers to each other.

2. A sock according to claim 1 wherein said equal length partial courses of said first and second layers are provided with uncut selvage edges along opposite sides of said first and second layers.

3. A sock according to claim 1 wherein said equal length partial courses of said first and second layers include cut yarn ends extending outwardly therefrom to provide cut selvage edges along opposite sides of said first and second layers.

4. A sock according to claim 1 wherein said plurality of gradually reducing and gradually increasing partial courses in the upper end portions of said first and second layers each comprise approximately four courses.

5. A sock according to claim 1 wherein said equal length partial courses forming said first and second layers of said pocket encompass substantially half of the wales in said leg portion of said sock.

6. A sock according to claim 1 wherein the length of said first and second layers of said pocket is substantially two times the width of said pocket.

7. A method of forming a knitted sock including a pocket integrally formed in the leg portion thereof, said method comprising the steps of circularly knitting a first group of complete seamless courses for a predetermined length, knitting a plurality of partial courses while gradually reducing the length of the partial courses, knitting a plurality of partial courses all of the same length, knitting a plurality of partial courses while gradually increasing the length of the partial courses and connecting the ends of the increasing length partial courses to the ends of the decreasing length partial courses along gore lines, knitting a second group of complete seamless courses while joining together corresponding portions of the last complete course of said first group of complete courses and the first complete course of said second group of complete courses to thereby form a looped section of said partial courses of the same length, continuing to knit to form the remaining leg and foot portions of said sock, connecting together opposite side edges of said looped section of partial courses of the same length to form a pocket including inner and outer layers joined at their lower ends along a fold line and with the upper ends of said inner and outer layers being integrally joined to said partial courses of gradually reducing and gradually increasing lengths.

8. A method of forming a knitted sock including a pocket integrally formed in the leg portion thereof, said method comprising the steps of circularly knitting a first group of complete seamless courses for a predetermined length, circularly knitting a plurality of partial courses all of the same length while forming cut yarn ends at each end of the partial courses, circularly knitting a second group of complete seamless courses while joining together corresponding portions of the last complete course of said first group of complete courses and the first complete course of said second group of complete courses to thereby form a looped section of said partial courses of the same length, continuing to knit to form the remaining leg and foot portions of said sock, connecting together opposite side edges of said looped section of partial courses of the same length to form a pocket including inner and outer layers joined at their lower ends along a fold line and with the upper ends of said inner and outer layers being integrally joined to the respective first and second groups of complete seamless courses.

9. A method according to claim 8 including the steps of reciprocatorily knitting a plurality of partial courses while gradually reducing the length of said partial courses prior to knitting said plurality of partial courses all of the same length, and reciprocatorily knitting a plurality of partial courses while gradually increasing the length of said partial courses and connecting the ends of said gradually increasing partial courses to the ends of said gradually decreasing partial courses along gore lines following the knitting of said plurality of partial courses all of the same length.

* * * * *